US006759985B2

(12) United States Patent
Acher et al.

(10) Patent No.: US 6,759,985 B2
(45) Date of Patent: Jul. 6, 2004

(54) ANISOTROPIC COMPOSITE ANTENNA

(75) Inventors: Olivier Acher, Saint Avertin (FR); François Duverger, Monts (FR); Gérard Leflour, Boulogne (FR); Hervé Jaquet, Paris (FR)

(73) Assignees: Commissariat a l'Energie Atomique, Paris (FR); Dassault Aviation, Paris (FR)

( * ) Notice: Subject to any disclaimer, the term of this patent is extended or adjusted under 35 U.S.C. 154(b) by 43 days.

(21) Appl. No.: 10/130,268

(22) PCT Filed: Dec. 21, 2000

(86) PCT No.: PCT/FR00/03641

§ 371 (c)(1),
(2), (4) Date: May 24, 2002

(87) PCT Pub. No.: WO01/47064

PCT Pub. Date: Jun. 28, 2001

(65) Prior Publication Data

US 2002/0180654 A1 Dec. 5, 2002

(30) Foreign Application Priority Data

Dec. 22, 1999 (FR) ..... 99 16228

(51) Int. Cl.[7] ..... H01Q 1/36
(52) U.S. Cl. ..... 343/700 MS; 343/767

(58) Field of Search ..... 343/700 MS, 767, 343/895, 909, 910, 911 R

(56) References Cited

U.S. PATENT DOCUMENTS

| | | | | |
|---|---|---|---|---|
| 5,563,616 A | | 10/1996 | Dempsey et al. | 343/753 |
| 5,726,655 A | | 3/1998 | Acher et al. | 342/1 |
| 6,075,485 A | * | 6/2000 | Lilly et al. | 343/700 MS |

OTHER PUBLICATIONS

O. Archer et al.: "Demonstration of antistropic composites with tuneable microwave permeability manufactured from ferromagnetic thin films" IEEE Transactions on Microwave Theory and Techniques, US, IEEE Inc. Mew York, vol. 44, No. 5, pp. 674–684 May 1, 1996.

* cited by examiner

*Primary Examiner*—James Clinger
(74) *Attorney, Agent, or Firm*—Oblon, Spivak, McClelland, Maier & Neustadt, P.C.

(57) ABSTRACT

The aerial comprises an element (20) capable of radiating or receiving an electromagnetic field, a conductive plane (22), and an anisotropic composite 24, formed by a stack of alternate ferromagnetic and electrically insulated layers. These layers or film are perpendicular to the conductive plane and to the electrical component (E) of the radiated or received field.

10 Claims, 8 Drawing Sheets

ANISOTROPIC COMPOSITE ANTENNA

FIELD OF THE INVENTION

The present invention relates to an anisotropic composite aerial. It is used in telecommunication applications, notably in the frequency band moving from about 50 MHz to about 4 GHz. The aerial of the invention can be used not only in emission but also in reception.

DESCRIPTION OF THE PRIOR ART

Aerials referred to as "skin" antenna are usually made up of a metal casing above which is arranged an element capable of radiating or receiving an electromagnetic field. The length of this element is generally in the vicinity of the half wavelength of the field to emit or to receive. It can be constituted by a slot drilled in a metal plate or of a metallic pattern (wire or strip).

FIG. 1 attached thus shows an aerial with an element 10 capable of radiating or receiving, a flat conductive plane 12, cylindrical or cubical conductive walls 13, a dielectric film 14 placed on the front side of the unit and serving as protection, and lastly a lead 16 connecting the element 10 to emission or reception means not shown. The electromagnetic field, radiated or received, is symbolically shown by the arrows R.

This type of aerial imposes severe restrictions on the distance D to be arranged between the radiating element and the conductive plane making up the bottom of the casing. This distance must be sufficiently large so that there is no destructive interference between the incident wave and the wave reflected by the casing, without however being excessive which would be harmful to the gain and to the bandwidth of the aerial.

In order to attempt to reduce these restrictions, it has been suggested adding a high-index dielectric between the element capable of radiating or receiving and the conductive plane, which allows decreasing the interval D. But this decrease is carried out to the detriment of the bandwidth of the aerial.

It has also been suggested using magnetic substrates in ferrite to tune the aerial on a certain frequency band. But the specific nature of this material (usually ceramic), as well as its mass and radio-electric properties restrict its use, in particular for large surfaces. Another considerable restriction is linked to the demagnetizing field of a substrate in ferrite. In fact, demagnetizing factors are associated with a cubic ferrite substrate, notably different from zero. This results in a dynamic demagnetizing field which is the product of a demagnetizing factor through the saturation magnetization of the ferrite. This field increases the resonance frequency while at the same time decreasing permeability of the ferrite substrate.

The static demagnetizing field (equal to the product of the demagnetizing factor in the direction of the field applied by the saturation magnetization),reduces the advantage of the ferrite substrate in the case that an outside magnetic field is applied in order to tune the properties of the aerial substrate. In fact, the field to be applied to the substrate is equal to the sum of the internal field and the demagnetizing field, and to increase the value of the field to be applied means increasing the strength of the system of magnets, or the consumption of an electromagnet.

The present invention has precisely the aim of resolving these disadvantages.

SUMMARY OF THE INVENTION

With this in mind, the invention advocates adding, between the conductive plane and the element capable of radiating or receiving, an anisotropic composite formed by a stack of alternate ferromagnetic and electrically insulated layers. These layers or film are perpendicular to the conductive plane. While they rest directly on this surface, they rest on their edge. Furthermore, these layers are directed or configured to be perpendicular (or approximately perpendicular) to the electrical component of the radiated or received field, component taken in the aerial plane.

The composite used in the invention is in itself recognized and sometimes called "LIFT" for Lamellar Insulator Ferromagnetic Tranche. This is described in the document FR-A-2 698 479. A measurement process of its electromagnetic characteristics is described in FR-A-2 699 683. Such a composite presents a high permeability and a low permittivity in the range of microwave frequency, for a plane wave arriving under normal incidence, with a linear polarization (magnetic field parallel to the layers and electric field perpendicular to the layers). It is possible to adjust the response in frequency of these materials by combining several ferromagnetic materials.

The composite in question is anisotropic, that is to say its electromagnetic properties are very different depending on the orientation of magnetic and electric fields in relation to the layers. If the electric field is perpendicular to the ferromagnetic layers, the material lets the electromagnetic wave penetrate. If, on the contrary, the electric field is parallel to the conductive lamina wafers, it is totally reflected by the material which then behaves like a metal.

When such an anisotropic composite is arranged in an aerial directly on the conductive plane, the surface impedance that it shows corresponds to a short-circuit seen through the line formed by the composite and for the favorable polarization (magnetic field parallel to the lamina wafers and electric field perpendicular to the layers). This impedance Z is defined by:

$$Z-Z_0 th(j.2\pi.N.e/\lambda)$$

where e is the composite thickness, $Z_0$ a typical impedance, $N^2=\epsilon_\perp . \mu_{//}$ and $Z^2=(\mu_{//}\epsilon_\perp)$ where $\epsilon_\perp$ and $\mu_{//}$ are respectively the permittivity counted perpendicular to the layers and $\mu_{//}$ the permeability counted parallel to the layers.

For other polarization, the impedance of the composite is near to that of a metal, that is to say near to zero.

The materials making up an anisotropic composite are light and easy to shape. Moreover, one can easily obtain responses in specific frequencies by taking advantage of the permeability of materials. In other respects, the conductive character of the composite for a particular direction of the field can be an advantage.

Moreover, the application on the anisotropic component of a magnetic field does not have the disadvantages encountered with ferrites. In fact, one can obtain high permeabilities with low volume fractions of magnetic matter. The demagnetizing field is thus proportional to the saturation magnetization divided by its volume fraction. One thus obtains values of static and dynamic demagnetizing field very much lower than in the case of ferrites. On an anisotropic composite aerial in compliance with the invention one can therefore use an external magnetic field, either to modify the tuning in frequency, or to adjust the level of permeability (by means of permanent magnets) to the desired frequency. In particular, an external magnetic field can be of use in reducing the magnetic losses to the working frequency.

In a precise manner, it is a general object of the present invention therefore to provide an aerial comprising an element capable of radiating or receiving an electromagnetic field, this element being arranged in front of a conductive plane, this aerial being typified in that it comprises moreover, between the element capable of radiating or receiving and the conductive plane, an anisotropic composite formed by a stack of alternate ferromagnetic and electrically insulated layers, these layers or film being perpendicular to the conductive plane and to the electrical component of the field radiated or picked up by the aerial.

The composite can be placed directly but not necessarily on the conductive plane.

As far as the element capable of radiating or receiving is concerned, it can be of any known shape straight or spiraled slot, straight or spiraled conductor wires or strips. The layers of composite must consequently always be oriented perpendicular (or approximately perpendicular) to the electrical component of the radiated or received field. This component is the component in the aerial plane (one does not take into account the component of the electric field oriented perpendicular to the plane of the aerial).

DETAILED DESCRIPTION OF SPECIFIC OF REALIZATION

Figure 1:
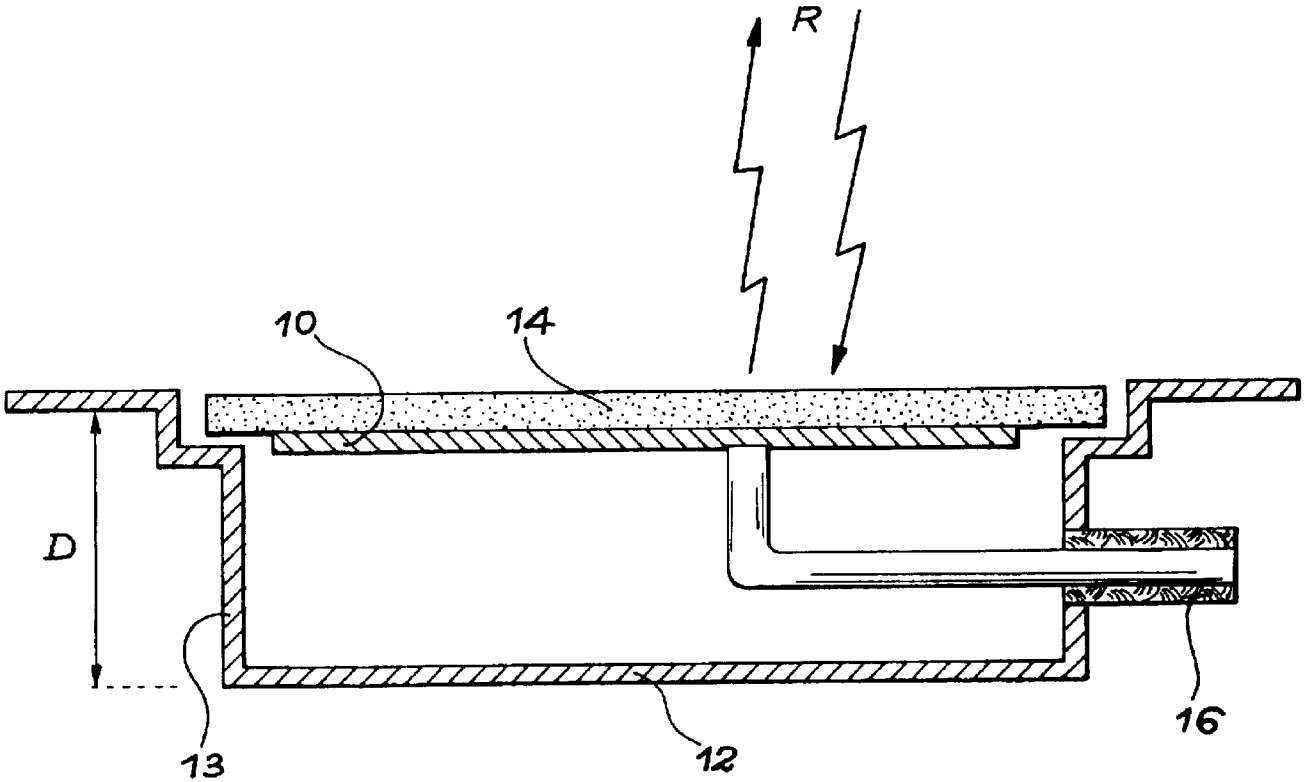
FIG. 1 already described, shows in cross-section a skin antenna according to the prior art.

As already mentioned, the composite used according to the invention notably plays the role of impedance transformer. It must be designed so that the aerial is as effective as possible. An order of magnitude of the efficiency in radiation of the aerial in relation to a similar aerial without short-circuit can be given by the formula:

$$E=-10\log(|Z/(Z+1)|).$$

where Z is the surface impedance.

For a composite whose load content in ferromagnetic material is not too low (typically higher than 2%), and for thicknesses very much less than a quarter of the wave length, the surface impedance is given as a first approximation by:

$$Z=j2\pi\mu_{//}e/\lambda$$

where e is the height of the composite and $\lambda$ the wave length in the void.

The composite placed on a conductive plane must show a sufficiently important normalized surface impedance (higher than 0.5) for the frequency considered, so that the effectiveness E is not too low. Typical thickness of the composite will be lower than $\lambda/20$. The composite can eventually be surmounted by a layer of dielectric or air, located between it and the radiating element. Generally speaking the thickness of this layer does not exceed $\lambda/10$.

A favorable case in point is that where the level of loss remains low ($\mu''/\mu'<0.15$ where $\mu''$ is the imaginary part of the permeability and $\mu'$ the real part) so that the standing waves penetrating the material and participating in the radiation of the aerial are not too quickly attenuated.

To make the composite, one can use a ferromagnetic material with a gyromagnetic resonance frequency higher than half the operating frequency of the aerial and for example 1.2 times lower than this frequency. The volume fraction of ferromagnetic material can be at least equal to 5%.

The permeability of an anisotropic composite depends on the properties of the ferromagnetic material. One can find the laws of dependence in the article headed "Demonstration of anisotropic composites with tuneable microwave permeability manufactured from ferromagnetic thin films" by O. ACHER, P. L E GOURRIEREC, G. PERRIN, P. BACLET and O. ROBLIN, published in "IEEE Trans. Microwave Theory and Techniques", vol. 44, 674, 1996.

The microwave frequency properties of a certain number of ferromagnetic materials are described notably in the article headed "Investigation of the gyromagnetic permeability of amorphous CoFeNiMoSiB manufactured by different techniques" by O. ACHER, C. BOSCHER, P. L E GUELLEC, P. BACLET and G. PERRIN, published in "IEEE Trans par Magn" vol. 32, 4833 (1996) and the article headed "Microwave permeability of ferromagnetic thin films with stripe domain structure" by O. ACHER, C. BOSCHER, B. BRULE, G. PERRIN, N. VUKADINOVIC, G. SURAN and H. JOISTEN, published in the Journal of Appl. Phys." 81, 4057 (1997).

The range of operating frequency of the aerial of the invention is the band from about 50 MHz to about 4 GHz. Above 4 GHz, permeability levels obtained with thin layers make them less attractive and the thicknesses essential for making aerials become less than a centimeter so that reducing this thickness even more is of no interest.

Figure 2:
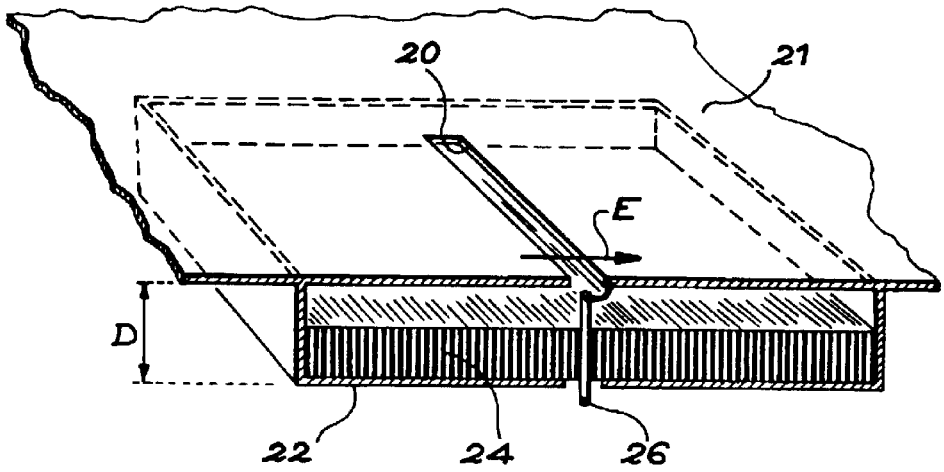
FIG. 2 shows a straight slot aerial.

FIG. 2 shows an example of aerial emitting around 1.9 GHz. The element capable of radiating or receiving is a slot 20 drilled in a conductive plate 21. The conductive plane 22 supports the anisotropic composite 24. The electrical connection is referenced 26. The electrical component of the field is marked E.

The slot 20 can be 79 mm long and 2 mm wide. The metal plate 21 can be a square plate 300×300 $mm^2$. Several heights D have been tested, in other words 40 mm, 20 mm, 10 mm and 5 mm which correspond respectively to $\lambda/4$,$\lambda/8$,$\lambda/16$ and $\lambda/32$.

The composite 24 is formed of flat lamina wafers and it is arranged in such a way that these wafers are all parallel to the longitudinal edges of the slot 20.

The composite can be made from a ferromagnetic film of composition $Co_{82}Zr_8Nb_{10}$ laid on a film of mylar (registered trademark). In an example of realization, the ferromagnetic was 1.3 $\mu$m thick and the mylar 10 $\mu$m thick. The edges of the films rest on the metal plane. The electric field at the level of the slot is perpendicular to this and is therefore perpendicular to the lamina wafers.

Figure 3:
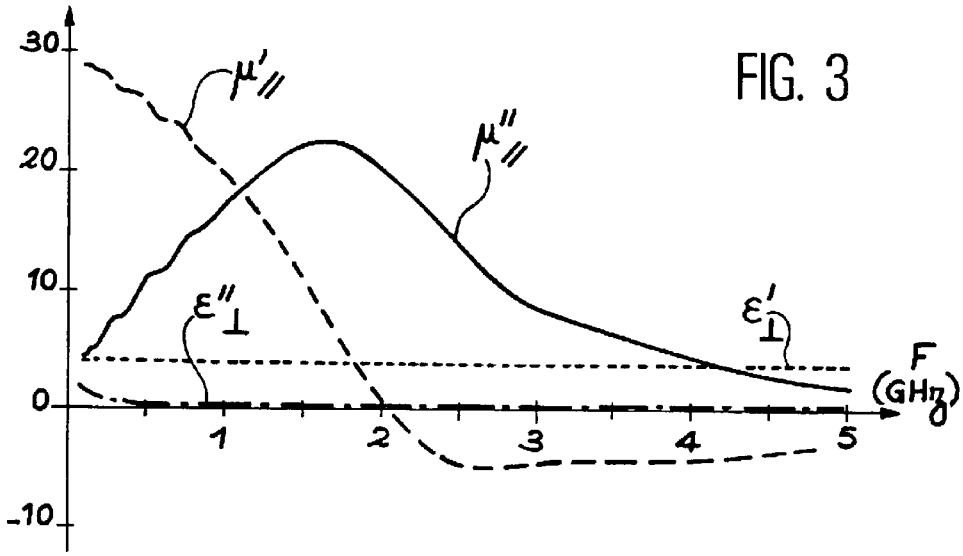
FIG. 3 gives the electromagnetic characteristics of a LIFT composite placed under a straight slot aerial.

The electromagnetic characteristics of the composite, for the favorable polarization (that is to say the permittivity perpendicular to the plane of the films ($\epsilon'_{\perp}$, $\epsilon''_{\perp}$) and the permeability in the plane of the films ($\mu'_{//}$, $\mu''_{//}$) are given in FIG. 3 for the material specified above. The thickness of the composite plate is 1.9 mm, which gives it an impedance whose module is in the vicinity of 1.5 to 1.9 GHz. It should be recalled that the permittivity of compositions parallel to the plane of these layers is very considerable and can therefore be considered as infinite.

Figure 4:
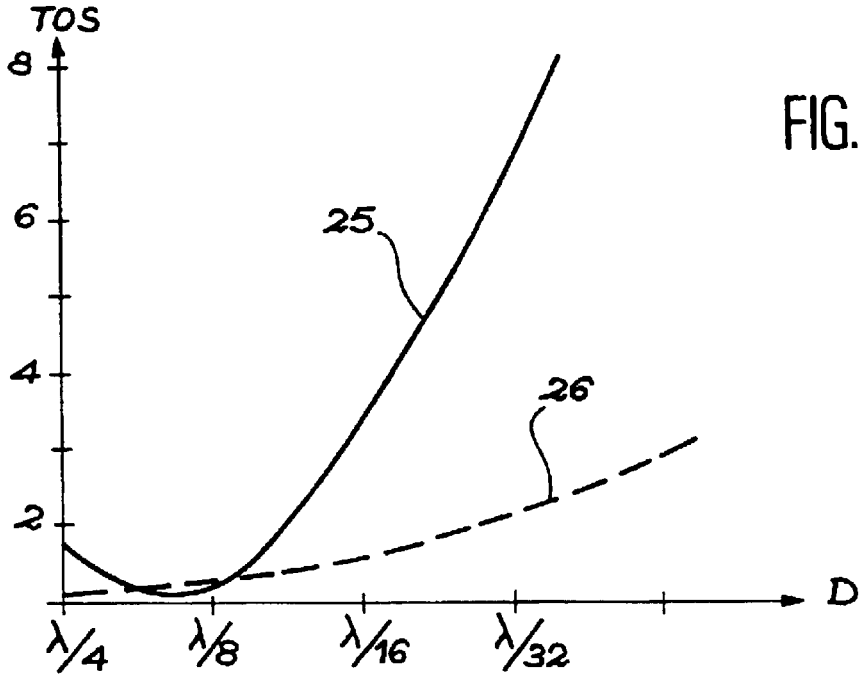
FIG. 4 shows the variation of the rate of standing waves depending on the frequency for an aerial according to FIGS. 2A and 2B with the composite of FIG. 3.
Figure 5:
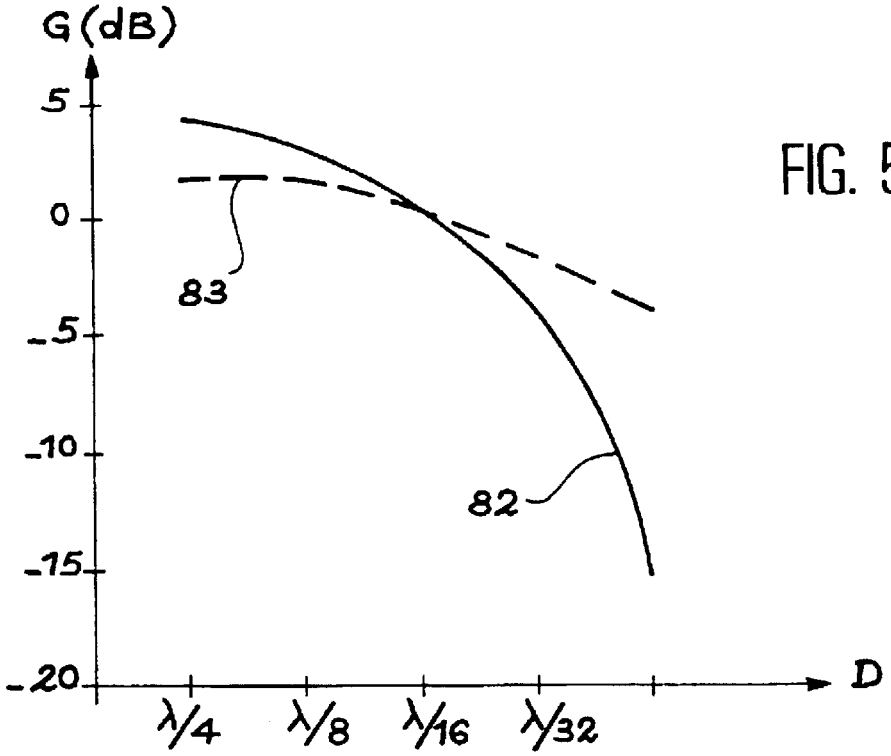
FIG. 5 shows the gain of the aerial with and without anisotropic composite depending on the height of the aerial.

The experimental characteristics of the aerial thus made are given in FIGS. 4 and 5 depending on the distance D, which is expressed in fractions of the wavelength. FIG. 4 gives the standing-wave ratio (SWR) and FIG. 5 the gain, G being expressed in Db. As soon as the height of the cavity D is less than 10 mm, that is to say at $\lambda/16$, the SWR at pick-up of the aerial increases considerably in the metallic configuration of the prior art (curve 25), whilst it remains very weak (in the region of 1.5) in the configuration of the invention (curve 26). For less important thicknesses, the absence of composite becomes totally unacceptable (SWR of 7 for D=5 mm in usual metallic configuration), which with the composite (for a thickness of 1.9 mm) one obtains a SWR of 3 which remains totally acceptable for numerous applications.

As far as the gain (FIG. 5) is concerned, for a height D=10 mm, this gain is the same with (curve 83) or without composite (curve 82). For even thinner thicknesses, one can note quick deterioration in the case of metal (prior art), whilst one only loses 3 dB in the case with composite.

FIGS. 4 and 5 show that for a thickness D of less than 10 mm, the performance of the aerial of the invention is superior in all ways to that of a classic aerial.

Figure 6:
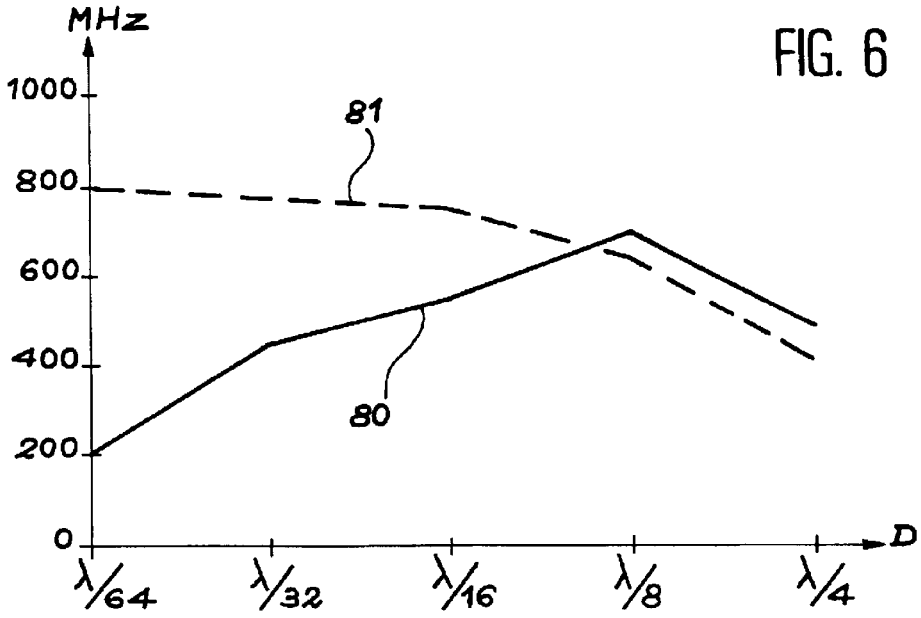
FIG. 6 shows the matching strip of the aerial.

Other measurements have been carried out, with a similar structure but with a length of slot equal to 14 cm, adapted to operating around 1.1 GHz. The lateral dimensions were identical, the height D being chosen between $\lambda/4$ and $\lambda/64$. FIG. 6 therefore shows the matching strip with a SWR lower than 3. It is remarkable to observe that this bandwidth is very wide even when one nears the plated configuration. In the case of the metal alone (prior art), the SWR deteriorates and the related bandwidth reduces.

One can try to improve the microwave behavior of the aerial, particularly its gain, by placing under the slot a composite which totally absorbs the wave radiated towards it, in other words an impedance equal to 1. It is also useful to increase the quantity $|Z/(Z+1)|$ by increasing the thickness or the load factor of the composite. One could in this way prefer a material with a certain permeability $\mu'$ but a low permeability $\mu''$ to the working frequency rather than a high permeability $\mu''$. This latter path is interesting in as far as the less one introduces magnetic losses in the aerial's environment, the less the risk of energy in the vicinity of the metallic plane being absorbed, in particular in modes or for incidences which are not generally taken into consideration. It is on the other hand reflected in phase with the radiated wave and therefore increases the effectiveness of the aerial.

Figure 7:
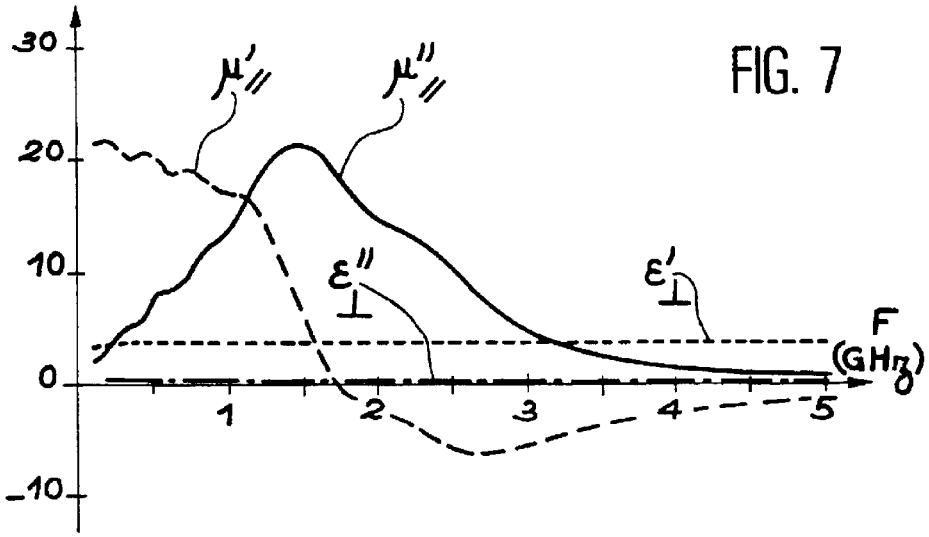
FIG. 7 gives the electromagnetic characteristics for a CoNbZr based composite.

Thus, for an aerial operating around 200 MHz, one could retain a material with similar electromagnetic characteristics to those given in FIG. 7. It concerns a LIFT made from CoNbZr, 0.9 $\mu$m thick laid on a film of kapton (registered trademark) 12.7 $\mu$m thick; the average thickness of glue is 2.5 $\mu$m; the density of the material is 1.8. With a permeability equal to 2l−3j at 200 MHz, this material shows limited losses. With a thickness of 11 mm, one achieves an impedance whose module is near to 1, which allows either pressing the slot on the composite or placing it at a distance of less than $\lambda/16$ in other words 93 mm).

Figure 8A:
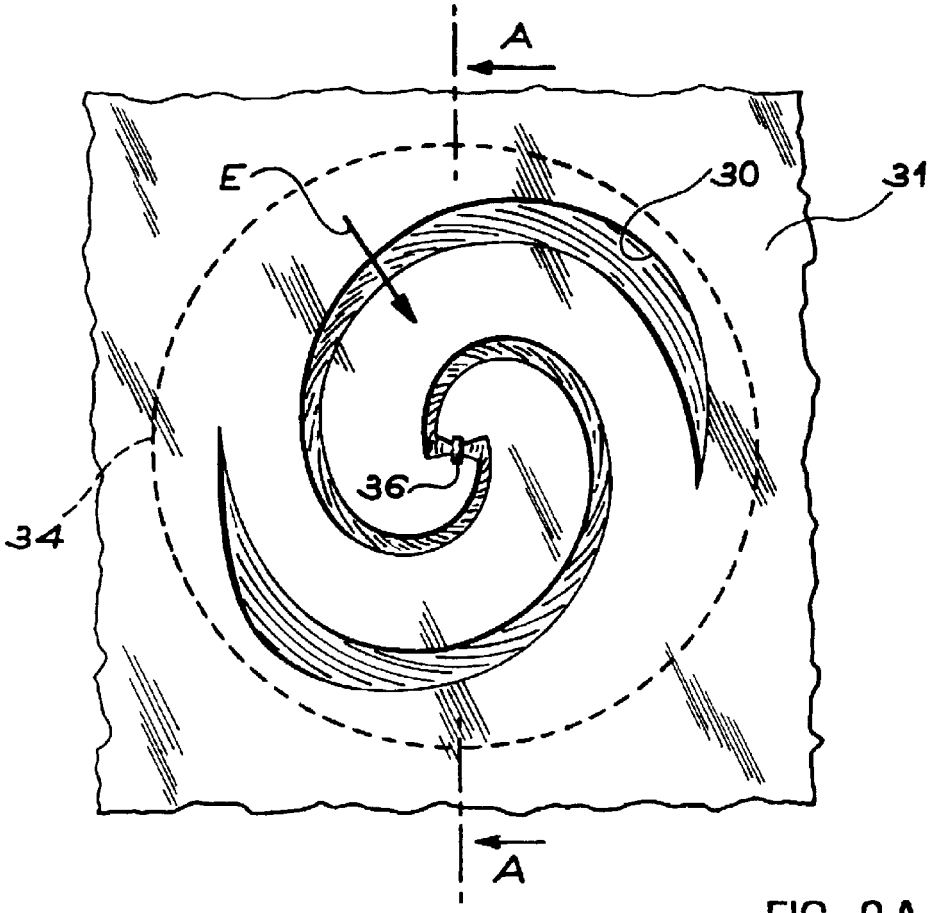
FIGS. 8A and 8B show in top view and in cross-section a spiraled slot aerial.
Figure 8B:
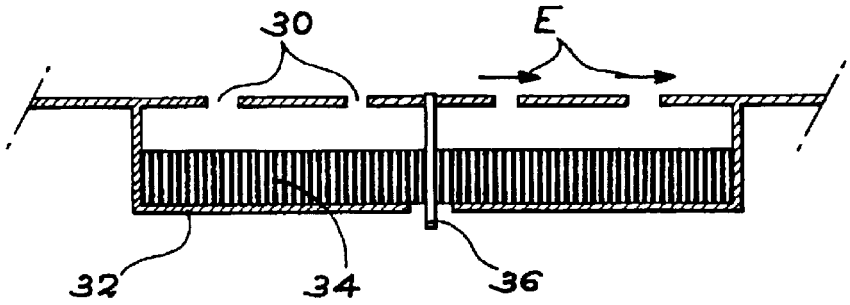
Figure 9:
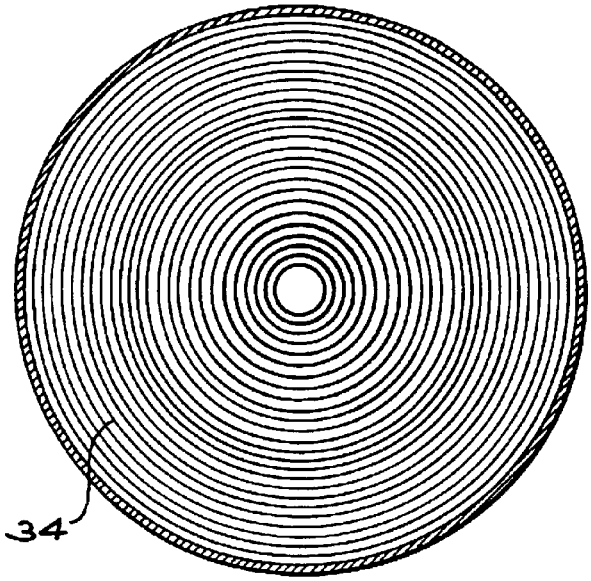
FIG. 9 shows in top view the appearance of the composite in the case of FIGS. 8A and 8B.

FIGS. 8A and 8B again illustrate a slot aerial but in the case of a spiraled slot. On FIG. 8A which is a top view, a spiraled slot 30 is drilled in a conductive plate 31. FIG. 8B which is an AA cross-section, shows a better view of the conductive plane 32, the composite 34 and the connection 36. This composite is shown in top view in FIG. 9 (the radiating element having been removed). On can therefore see in the spiraled slot 30 the circles of composite (FIG. 8A). The electrical component of the radiated or received field is marked E.

In the method of realization illustrated, the ferromagnetic and insulating films are cylindrical. The spiral of the radiating slot and the composite films are not therefore strictly parallel, but the deviation in relation to the parallelism is small (less than 10°) and does not affect the performance of the aerial.

In order to obtain a broadband aerial emitting around 500 MHz (which corresponds to a wavelength of 600 mm) one could adopt a slot length in the region of $\lambda/2$, or 300 mm. One can make the composite from CoFeNiSiB, 1.3 $\mu$m thick, with a glue thickness of 2.5 $\mu$m. The density of material is then 2.3. Thickness as little as 1 mm resulting in obtaining impedances higher than 1.5 hence good properties for depths of cavity in the region of $\lambda/10$ or less.

Realization of a composite with spiraled films approximately parallel to the slot can be made by winding strips on preforms, or by any other means.

The zone of radiation of the spiraled slot depends on the radius of the latter, this value being linked to the frequency. Optimization of the thickness of the composite material must be dependent on the radius of the cavity.

Another embodiment, easier to realize, consists in manufacturing a composite toroid through winding and placing the spiraled slot concentrically. This solution respects the geometry of the fields less but is acceptable if the opening of the spiral is less than 30°.

Figure 10:
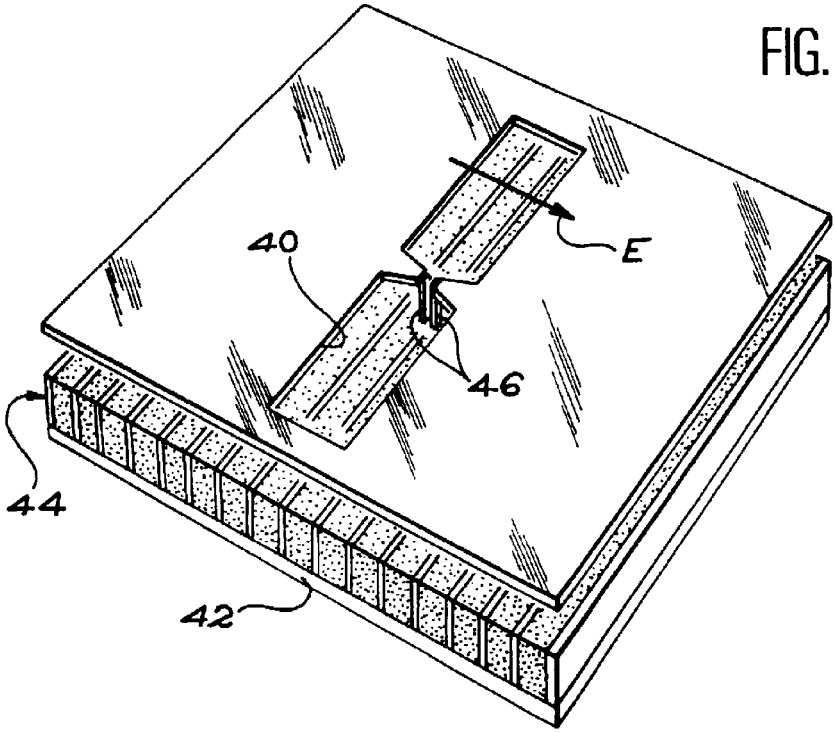
FIG. 10 shows a slot aerial with central excitation.

FIG. 10 illustrates again a slot aerial but in an embodiment where the slot is wide and excited in its center. The slot is reference 40, the conductive plane 42, the composite 44 and the supply connection 46. The lamina wafers of composite are still oriented parallel to the longitudinal edges of the slot, in other words perpendicular to the component E.

Figure 11A:
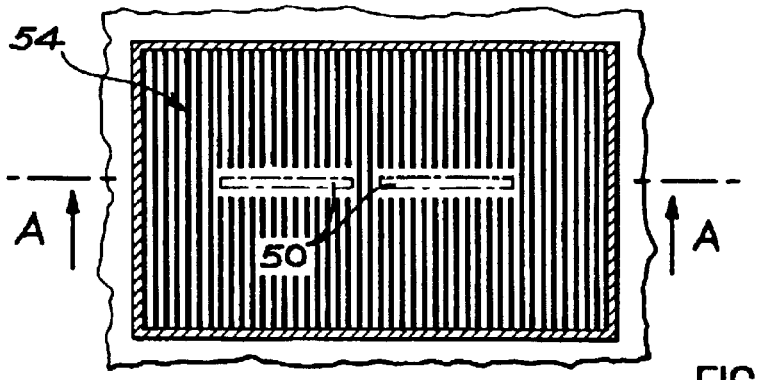
FIGS. 11A and 11B show, in top view and cross-section, an aerial with two straight conductor wires.
Figure 11B:
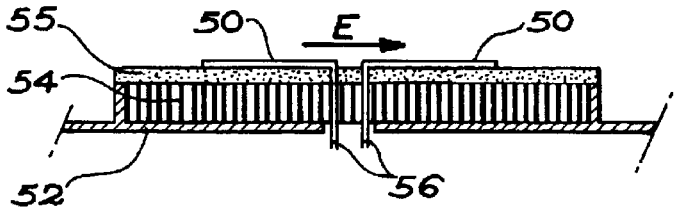

FIGS. 11A and 11B illustrate, respectively in top view and in AA cross-section, a realization mode in which the aerial is of the dipole type. The element capable of radiating or receiving is constituted by two conductor wires 50. The conductive plane 52 supports the composite 54 and a dielectric film 55 can support the two wires. The connection 56 is double. The lamina wafers of the composite 54 are oriented perpendicular to the wires. For operation at 2 GHz, the length of each wire can be near to 75 mm for an operation in $\lambda/2$. For the composite one can use the material whose characteristics have been illustrated in FIG. 3 with a thickness of 1.5 to 3 mm. The thickness of the dielectric film 56 does not exceed $\lambda/16$.

Figure 12:
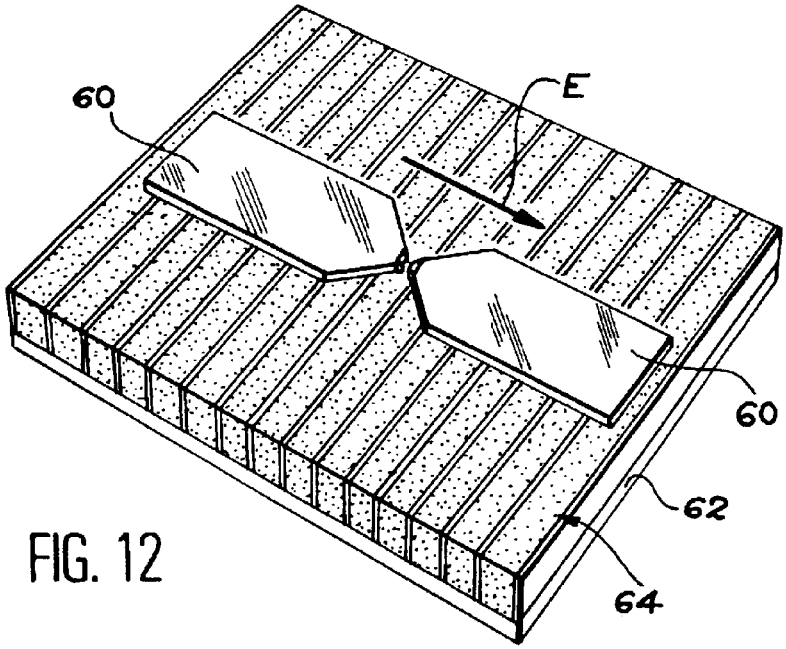
FIG. 12 shows an aerial with two conductive strips.

The wires can be replaced by conductor strips as illustrated in FIG. 12. These strips bear the reference 60, the conductive plane reference 62 and the composite reference 64. The layers of the composite are still lamina wafers perpendicular to the largest dimension of the strips 60.

Figure 13A:
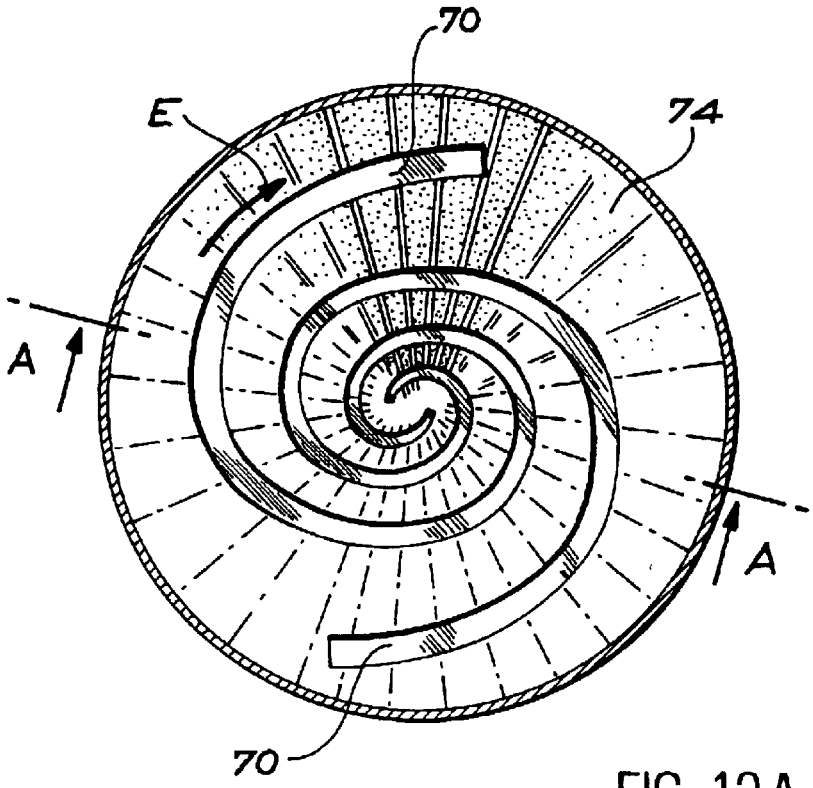
FIGS. 13A and 13B show in top view and cross-section a spiraled conductor strip aerial.
Figure 13B:
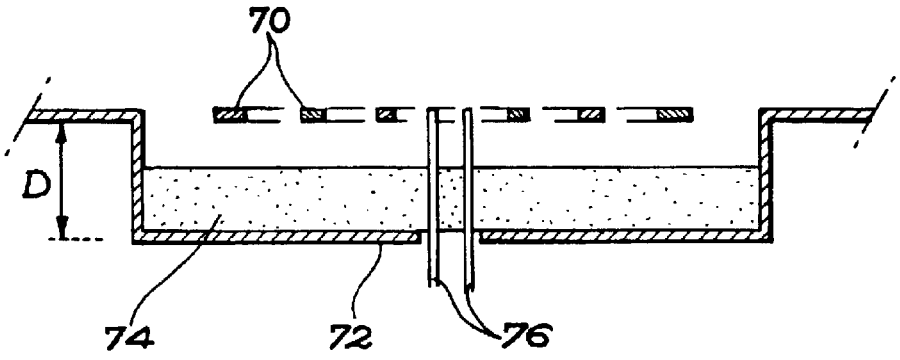

Lastly in FIGS. 13A and 13B which are respectively top views and AA cross-sections, the conductor wires 70 are no longer straight, but have a spiraled shape. The composite 74 is therefore formed of radial lamina wafers approximately perpendicular to the conductor wires. The connection 76 is double and supplies the spiraled wires.

What is claimed is:

1. An aerial antenna comprising:

an element configured to at least one of radiate and receive an electromagnetic field;

a conductive plane; and an anisotropic substrate between said element and said conductive plane, and comprising an anisotropic composite formed by a stack of alternate ferromagnetic and electrically insulated layers, said layers forming planes perpendicular to the conductive plane and to an electrical component (E) of a radiated or received field.

2. Aerial antenna according to claim 1, wherein the anisotropic composite contacts directly the conductive plane.

3. Aerial antenna according to claim 1, wherein said element comprises a straight slot in a conductive plate, and the layers of the anisotropic composite comprise flat lamina wafers parallel to the said slot.

4. Aerial antenna according to claim 1, wherein said element comprises at least one spiraled slot in a conductive plate, and the layers of the anisotropic composite are wound approximately parallel to said slot.

5. Aerial antenna according to claim 1, wherein said element comprises two conductive strips, and the layers of the anisotropic composite comprise flat lamina wafers perpendicular to the strips.

6. Aerial antenna according to claim 1, wherein said element comprises at least one conductor wire, and the layers of the anisotropic composite radial and approximately perpendicular to the wire.

7. Aerial antenna according to claim 1, wherein the ferromagnetic layers have a gyromagnetic resonance frequency lower than 1.2 times a working frequency of the aerial.

8. Aerial antenna according to claim 1, wherein a volume fraction of a ferromagnetic material of the stack is at least equal to 5%.

9. Aerial antenna according to claim 5, wherein said conductive strips comprise two straight conductor wires.

10. Aerial antenna according to claim 6, wherein said at least one conductor wire comprises a strip spirally-wound.

* * * * *